US008901830B2

(12) United States Patent
Wu et al.

(10) Patent No.: US 8,901,830 B2
(45) Date of Patent: Dec. 2, 2014

(54) POWER SUPPLY SYSTEM AND CONTROLLING METHOD

(75) Inventors: Hsiang-Chen Wu, Taoyuan County (TW); Chao-Pin Chen, Taoyuan County (TW)

(73) Assignee: Delta Electronics, Inc., Guishan Township, Taoyuan County (TW)

( * ) Notice: Subject to any disclaimer, the term of this patent is extended or adjusted under 35 U.S.C. 154(b) by 194 days.

(21) Appl. No.: 13/607,278

(22) Filed: Sep. 7, 2012

(65) Prior Publication Data

US 2013/0249416 A1 Sep. 26, 2013

(30) Foreign Application Priority Data

Mar. 23, 2012 (TW) ..... 101110030 A

(51) Int. Cl.
*H05B 37/02* (2006.01)

(52) U.S. Cl.
USPC ..... 315/185 R; 315/224

(58) Field of Classification Search
USPC ..... 315/185 R, 291, 224, 294, 297, 307, 315/209 R
See application file for complete search history.

(56) References Cited

U.S. PATENT DOCUMENTS

| | | | | |
|---|---|---|---|---|
| 2011/0181199 | A1 | 7/2011 | Lin et al. | |
| 2012/0074866 | A1 * | 3/2012 | Zhang et al. | 315/291 |

FOREIGN PATENT DOCUMENTS

| | | | |
|---|---|---|---|
| JP | 4-206392 | A | 7/1992 |
| JP | 6-233590 | A | 8/1994 |
| JP | 2003-274643 | A | 9/2003 |
| JP | 2006-511078 | A | 3/2006 |
| JP | 2007-281424 | A | 10/2007 |
| JP | 2011-205868 | A | 10/2011 |
| JP | 2011-249771 | A | 12/2011 |
| WO | WO 2004/057921 | A1 | 7/2004 |
| WO | WO 2011/010343 | A1 | 1/2011 |

* cited by examiner

*Primary Examiner* — Daniel D Chang
(74) *Attorney, Agent, or Firm* — Muncy, Geissler, Olds & Lowe, P.C.

(57) ABSTRACT

A method for controlling a current of a power supply system includes following steps. First, the power supply is started to produce an output current and the output current is increased. Afterward, the output current is decreased when the output current increases to a rated output current value. Finally, the output current is maintained at a typical output current value when the output current decreases to the typical output current value.

16 Claims, 7 Drawing Sheets

POWER SUPPLY SYSTEM AND CONTROLLING METHOD

This application is based on and claims the benefit of Taiwan Application No. 101110030 filed Mar. 23, 2012 the entire disclosure of which is incorporated by reference herein.

BACKGROUND

1. Technical Field

The present disclosure relates generally to a power supply system and a method of controlling current thereof, and more particularly to a power supply system for driving light-emitting diodes and a method of controlling current thereof.

2. Description of Related Art

Safety certifications provide clear statements and guidance for manufacturing equipment and parts of products, thus providing safe and high quality products to users or operators. The main purpose is to prevent and reduce danger of electric shock, energy hazards, fire, mechanical and heat hazards, radiation hazards, chemical hazards, and so on to ensure life and property safety of users or operators. Accordingly, the manufacturing equipment and the parts of products must pass related safety certifications in different countries before shipping.

At present, most of the power supply manufacturers adopt the following safety certifications, such as International Electrotechnical Commission (IEC), Verband Deutscher Elektrotechnikere (VDE), Underwriter Laboratory (UL), Technisher Uberwachungs Verein (TUV), SLG-CPC Testlaboratory Co., Ltd, or Canadian Standards Association (CSA). In particular, the required applications for safety certifications are more when test projects of safety certifications are more diverse and stringent. For this reason, the required costs of safety certifications are relatively higher, especially the international certification costs. In addition, the internal components and output parameters of the tested power supply must be fixed when the power supply is certificated according to demands of the safety certification. In addition, different models of the power supply need to apply different safety certifications once the output current of the power supply is changed but electronic components and circuit structures are not, thus significantly increasing the research and development costs and manufacturing costs. Therefore, visibility of products and competitiveness of companies will be affected.

Accordingly, it is desirable to provide a power supply system for driving light-emitting diodes and a method of controlling current thereof so that different output currents for the identical power supply can be applied to the same power safety certification.

SUMMARY

Accordingly, the method of controlling an output current of a power supply includes steps as follows: (a1) the output current is increased after the power supply is started up; (b1) the output current is decreased when the output current is increased to a rated output current value; and (c1) the output current is maintained at a typical output current value when the output current is decreased to the typical output current value.

Accordingly, the method of controlling an output current of a power supply includes steps as follows: (a2) the output current is increased after the power supply is started up; (b2) the output current is decreased when the output current is increased to a rated output current value; (c2) the output current is maintained at a buffer output current value when the output current is decreased to the buffer output current value; (d2) the output current is further decreased after a buffer maintaining time; and (e2) the output current is maintained at a typical output current value when the output current is decreased to the typical output current value.

Accordingly, the method of controlling an output current of a power supply includes steps as follows: (a3) the output current is increased after the power supply is started up; (b3) the output current is maintained at a rated output current value when the output current is increased to the rated output current value; (c3) the output current is decreased after a rated maintaining time; (d3) the output current is maintained at a typical output current value when the output current is decreased to the typical output current value.

Accordingly, the method of controlling an output current of a power supply includes steps as follows: (a4) the output current is increased after the power supply is started up; (b4) the output current is maintained at a rated output current value when the output current is increased to the rated output current value; (c4) the output current is decreased after a rated maintaining time; (d4) the output current is maintained at a buffer output current value when the output current is decreased to the buffer output current value; (e4) the output current is further decreased after a buffer maintaining time; and (f4) the output current is maintained at a typical output current value when the output current is decreased to the typical output current value.

Accordingly, the power supply system is provided for dimming a light-emitting diode string. The power supply system includes a power supply, a current-detecting unit, an output current control unit, and a feedback circuit. The power supply receives an AC power and converts the AC power into a DC power for driving the light-emitting diode string. The current-detecting unit detects an output current of the power supply and produces a current feedback signal. The output current control unit receives a dimming signal and produces a current control signal. The feedback circuit receives the current feedback signal and the current control signal and produces a feedback control signal to control the output current of the power supply by the output current control unit.

It is to be understood that both the foregoing general description and the following detailed description are exemplary, and are intended to provide further explanation of the invention as claimed. Other advantages and features of the invention will be apparent from the following description, drawings and claims.

DETAILED DESCRIPTION

Figure 1:
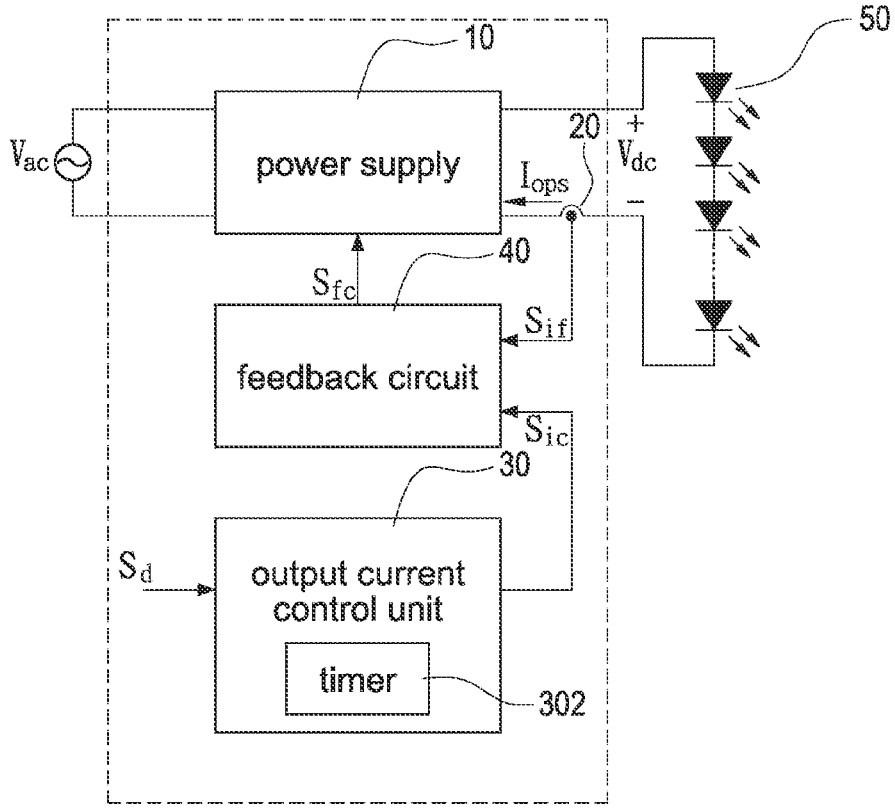
FIG. 1 is a circuit block diagram of a power supply system for driving light-emitting diodes according to the present invention.

Reference will now be made to the drawing figures to describe the present invention in detail.

Reference is made to FIG. 1 which is a circuit block diagram of a power supply system for driving and dimming light-emitting diodes (LEDs) according to the present invention. Note that, the power supply system for driving LEDs in FIG. 1 is described with reference to the embodiment of the disclosure, but is not intended to limit scope of the invention. The power supply system for driving the LEDs mainly includes a power supply 10, a current-detecting unit 20, an output current control unit 30, and a feedback circuit 40.

The power supply 10 receives an external AC power Vac and converts the AC power Vac into a DC power Vde for driving the light-emitting diode string 50. The current-detecting unit 20 is electrically connected to an output side of the power supply 10 for detecting an output current Iops of the power supply 10. After detecting the output current Iops, the current-detecting unit 20 sends a current feedback signal Sif to an input terminal (not shown) of the feedback circuit 40. In addition, the output current control unit 30 receives a dimming signal Sd to produce a current control signal Sic and the current control signal Sic is sent to another input terminal (not shown) of the feedback circuit 40. In particular, the output current control unit 30 can be a microprocessor (μP), a microcontroller (μC), a field-programmable gate array (FPGA), a programmable integrated circuit, an application-specific integrated circuit (ASIC), or so on, but not limited. In addition, the dimming signal Sd is a pulse-width modulation (PWM) signal and a duty cycle of the dimming signal Sd is controlled to adjust illumination of the light-emitting diode string 50. Further, the dimming signal Sd can be an internal dimming signal or an external dimming signal, but not limited. As mentioned above, the feedback circuit 40 receives the current feedback signal Sif and the current control signal Sic to produce a feedback control signal Sfc, thus controlling the output current Iops of the power supply 10. Especially, the output current Iops of the power supply 10 can be controlled to meet within the scope of the required dimming current by controlling the dimming signal Sd. Further, a timer 302, which is installed inside the output current control unit 30, can be used to provide the time-dependent control, such as a maintaining time, a steady-state, or so on, for the output current.

Figure 2:
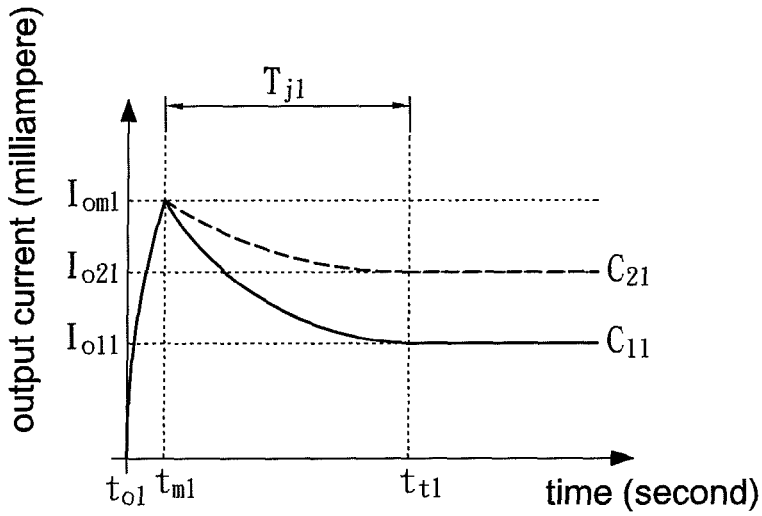
FIGS. 2-5 are schematic waveform charts of a method of controlling output current of a power supply in accordance with some embodiments of the present invention.
Figure 6:
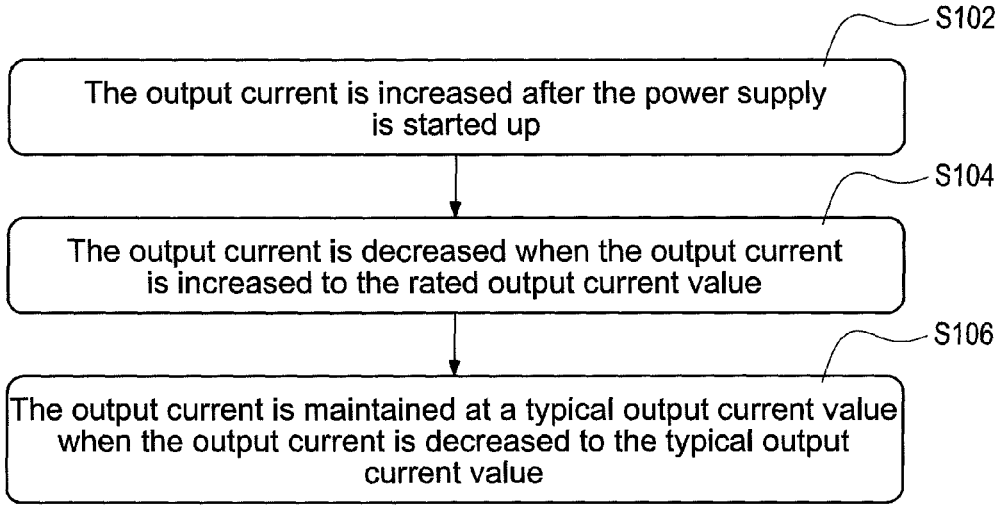
FIGS. 6-9 are flowcharts of a method of controlling output current of a power supply in accordance with some embodiments of the present invention.

Reference is made to FIG. 2 which is a schematic waveform chart of a method of controlling output current of a power supply according to a first embodiment of the present invention. In following descriptions, different output current curves are exemplified for further demonstration of controlling the output current. The abscissa represents the time (in seconds) and the ordinate represents the output current (in milliamperes). Further, reference is made to FIG. 6 which is a flowchart of a method of controlling output current of a power supply according to the first embodiment of the present invention. Especially, there are two output current curves are shown, namely, a first current curve C11 and a second current curve C21. The major difference between the two current curves is that steady-state values of the output current are different after the power supply 10 is completely started up. In other words, the steady-state output current value (referred to as a "first typical output current value" hereinafter) in the first current curve C11 is less than that (referred to as a "second typical output current value" hereinafter) in the second current curve C21. More detailed operation of controlling the output current will be explained later by assumed output current values.

The method of controlling an output current of the power supply includes steps as follows: First, the output current Io is increased after the power supply is started up (S102). The power supply is started up at a startup time point t01 and then the output current Io of the power supply 10 is increased to a rated output current value Iom1 at a rated time point tm1. Note that, in order to simplify the description of controlling the output current Io, the transient overshoot of the output current Io is not considered in all embodiments of the present invention.

Afterward, the output current Io is decreased when the output current Io is increased to the rated output current value Iom1 (S104). In this embodiment, it is assumed that the rated output current value Iom1 is equal to 450 mA, that is, the output current Io is decreased when the output current Io is increased to 450 mA. Finally, the output current Io is maintained at a typical output current value when the output current Io is decreased to the typical output current value (S106). That is, the typical output current value is used to provide a constant-current dimming for the LED string. In this embodiment, a first typical output current value Io11 is provided when the power supply 10 is operated under the first current curve C11. Further, it is assumed that the first typical output current value Io11 is equal to fifty percent of the rated output current value Iom1, namely, the first typical output current value Io11 is 225 mA. Similarly, a second typical output current value Io21 is provided when the power supply 10 is operated under the second current curve C21. Further, it is assumed that the second typical output current value Io21 is equal to seventy-five percent of the rated output current value Iom1, namely, the second typical output current value Io21 is 337.5 mA. Note that, the above-mentioned two typical output current values Io11, Io21 meet within the scope of the required dimming current and also the first typical output current value Io11 and the second typical output current value Io21 are less than the rated output current value Iom1. In other words, different output currents of the identical power supply can be controlled by software and firmware without the need to substitute electronic components inside the power supply, while the same power safety certification can be satisfied. That is, different output currents operated under the first current curve C11, the second current curve C21, or other current curves can be applied to the same power safety certification. Especially, the output current Io reaches to the first typical output current value Io11 or the second typical output current value Io21 at a typical time point tt1. In particular, a time difference between the rated time point tm1 and the typical time point tt1 is a current regulating time Tj1, namely, Tj1=tt1−tm1. Also, the current regulating time Tj1 is preferably controlled less than ten seconds in present invention. Note that, the rated time point tm1, the typical time point tt1, and the current regulating time Tj1 are controlled by a timer.

For the ordinary LED street lamp system with a dimming function, the LED street lamps are generally controlled according to ambient light. For this reason, the dimming time interval of the LED street lamps is usually controlled in time unit of hours under normal climatic conditions. Unlike the LED street lamp system, the operation of controlling the output current of the power supply 10 in the present invention is focused on the period from the starting condition to the steady-state condition of the power supply 10.

Figure 3:
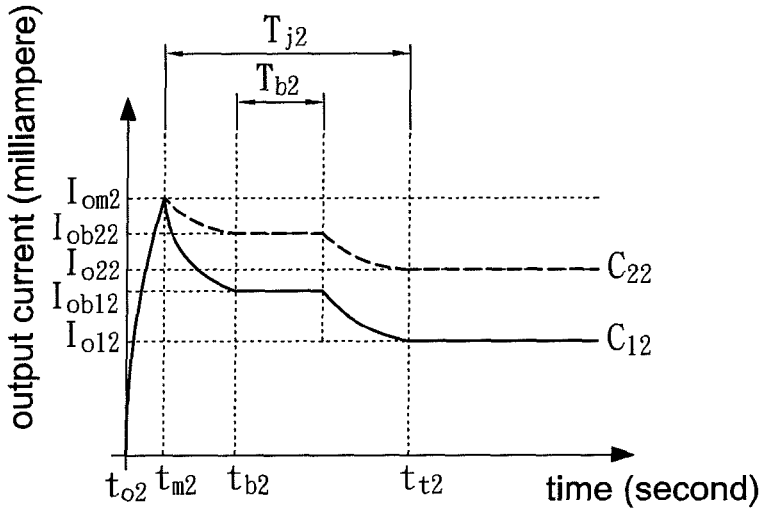
Figure 7:
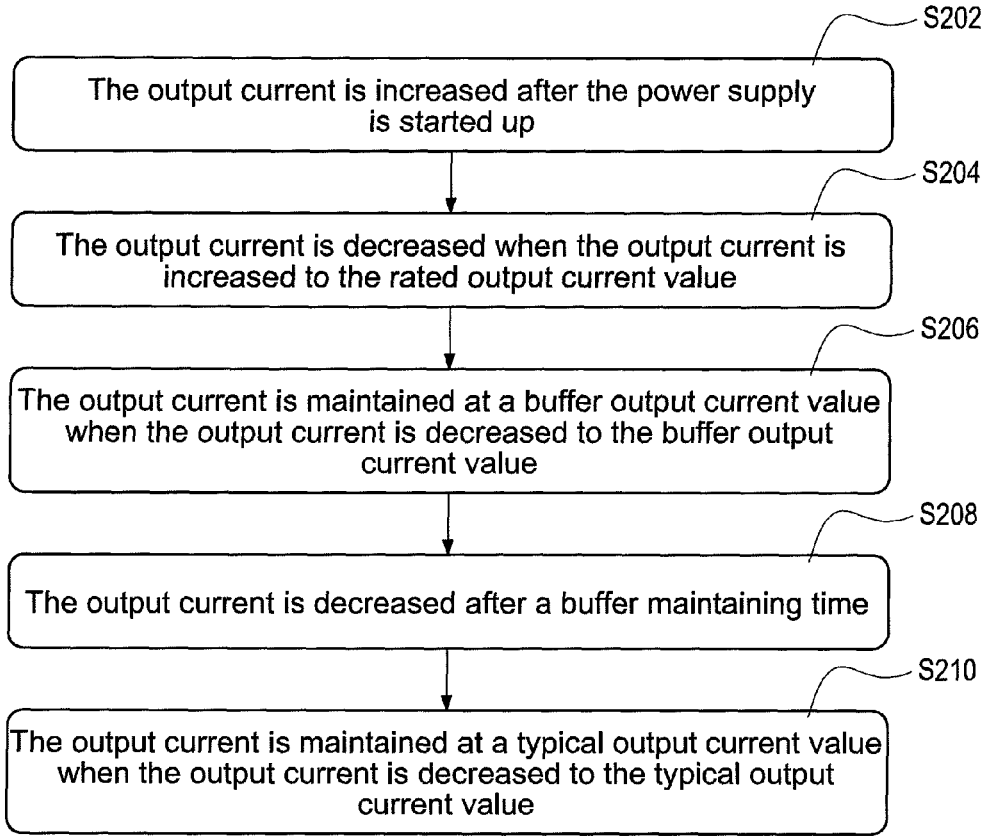

Reference is made to FIG. 3 which is a schematic waveform chart of the method of controlling output current of the power supply according to a second embodiment of the present invention. In following descriptions, different output current curves are exemplified for further demonstration of controlling the output current. The abscissa represents the time (in seconds) and the ordinate represents the output current (in milliamperes). Further, reference is made to FIG. 7 which is a flowchart of a method of controlling output current of the power supply according to the second embodiment of the present invention. Especially, there are two output current curves are shown, namely, a first current curve C12 and a second current curve C22. The major difference between the two current curves is that steady-state values of the output current are different after the power supply 10 is completely started up. In other words, the steady-state output current value (referred to as a "first typical output current value" hereinafter) in the first current curve C12 is less than that (referred to as a "second typical output current value" hereinafter) in the second current curve C22. More detailed operation of controlling the output current will be explained later by assumed output current values.

The method of controlling an output current of the power supply includes steps as follows: First, the output current is increased after the power supply is started up (S202). The power supply is started up at a startup time point t02 and then the output current Io of the power supply 10 is increased to a rated output current value Iom2 at a rated time point tm2. Note that, in order to simplify the description of controlling the output current, the transient overshoot of the output current is not considered in all embodiments of the present invention.

Afterward, the output current Io is decreased when the output current Io is increased to the rated output current value Iom2 (S204). In this embodiment, it is assumed that the rated output current value Iom2 is equal to 450 mA, that is, the output current Io is decreased when the output current Io is increased to 450 mA. Afterward, the output current Io is maintained at a buffer output current value when the output current Io is decreased to the buffer output current value (S206). Especially, the output current Io reaches to a first buffer output current value Iob12 or a second buffer output current value Iob22 at a buffer time point tb2. Afterward, the output current Io is decreased after a buffer maintaining time Tb2 (S208). That is, the power supply 10 continuously outputs the first buffer output current value Iob12 and the second buffer output current value Iob22 during the buffer maintaining time Tb2 and then decreases the output current Io after the buffer maintaining time Tb2.

Finally, the output current Io is maintained at a typical output current value when the output current Io is decreased to the typical output current value (S210). That is, the typical output current value is used to provide a constant-current dimming for the LED string. In this embodiment, a first typical output current value Io12 is provided when the power supply 10 is operated under the first current curve C12. Further, it is assumed that the first typical output current value Io12 is equal to fifty percent of the rated output current value Iom2, namely, the first typical output current value Io12 is 225 mA. Similarly, a second typical output current value Io22 is provided when the power supply 10 is operated under the second current curve C22. Further, it is assumed that the second typical output current value Io22 is equal to seventy-five percent of the rated output current value Iom2, namely, the second typical output current value Io22 is 337.5 mA. However, the above-mentioned two typical output current values Io12, Io22 are only exemplified but are not intended to limit the scope of the disclosure. Note that, the above-mentioned two typical output current values Io12, Io22 meet within the scope of the required dimming current and also the first typical output current value Io12 and the second typical output current value Io22 are less than the rated output current value Iom2. In other words, different output currents of the identical power supply can be controlled by software and firmware without the need to substitute electronic components inside the power supply, while the same power safety certification can be satisfied. That is, different output currents operated under the first current curve C12, the second current curve C22, or other current curves can be applied to the same power safety certification. Especially, the output current Io reaches to the first typical output current value Io12 or the second typical output current value Io22 at a typical time point tt2. Further, the first buffer output current value Iob12 and the second buffer output current value Iob22 are greater than the corresponding first typical output current value Io12 and the second typical output current value Io22, respectively. Note that, a major difference between the second embodiment and the first embodiment (as shown in FIG. 2) is that the first buffer output current value Iob12 or the second buffer output current value Iob22 is continuously outputted during the buffer maintaining time Tb2 so that the variation of the output current Io (from the rated output current value Iom2 to the first typical output current value Io12 or the second typical output current value Io22) is more smooth. In addition, the amount of the buffer output current value between the rated output current value Iom2 and the first typical output current value Io12 or the second typical output current value Io22 can be plural according to the practical applications. In particular, a time difference between the rated time point tm2 and the typical time point tt2 is a current regulating time Tj2, namely, Tj2=tt2−tm2. Also, the current regulating time Tj2 is preferably controlled less than ten seconds and the buffer maintaining time Tb2 is preferably controlled less than one second in present invention. Note that, the rated time point tm2, the buffer time point tb2, the typical time point tt2, the buffer maintaining time Tb2, and the current regulating time Tj2 are controlled by a timer.

For the ordinary LED street lamp system with a dimming function, the LED street lamps are generally controlled according to ambient light. For this reason, the dimming time interval of the LED street lamps is usually controlled in time unit of hours under normal climatic conditions. Unlike the LED street lamp system, the operation of controlling the output current of the power supply 10 in the present invention is focused on the period from the starting condition to the steady-state condition of the power supply 10.

Figure 4:
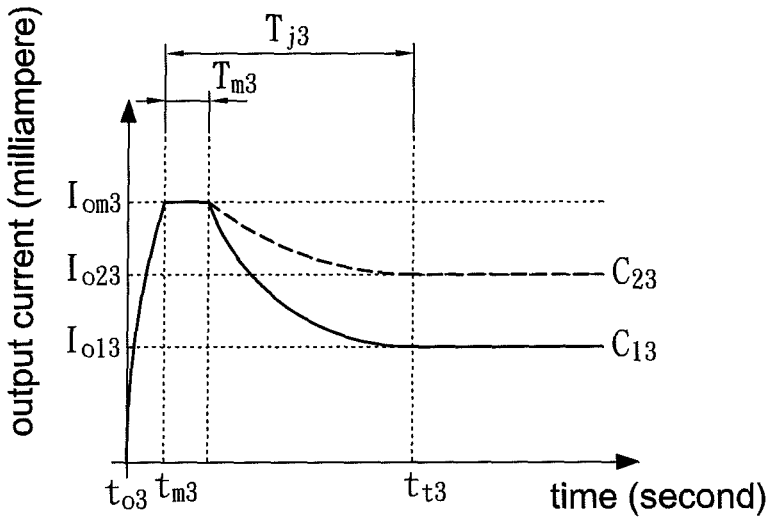
Figure 8:
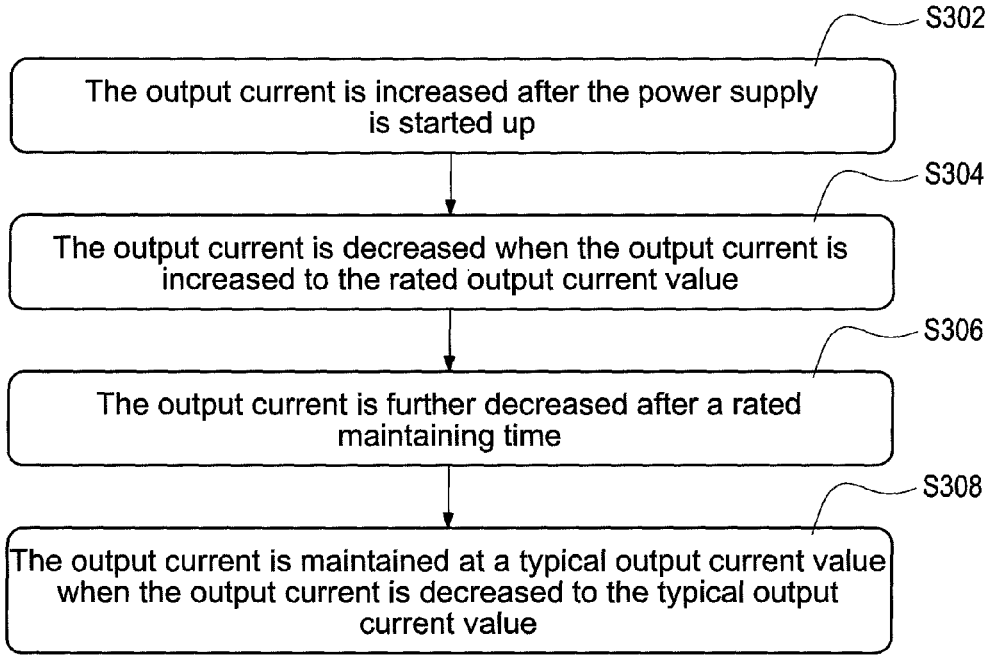

Reference is made to FIG. 4 which is a schematic waveform chart of the method of controlling output current of the power supply according to a third embodiment of the present invention. In following descriptions, different output current curves are exemplified for further demonstration of controlling the output current. The abscissa represents the time (in seconds) and the ordinate represents the output current (in milliamperes). Further, reference is made to FIG. 8 which is a flowchart of a method of controlling output current of the power supply according to the third embodiment of the present invention. Especially, there are two output current curves are shown, namely, a first current curve C13 and a second current curve C23. The major difference between the two current curves is that steady-state values of the output current are different after the power supply 10 is completely started up. In other words, the steady-state output current value (referred to as a "first typical output current value" hereinafter) in the first current curve C13 is less than that (referred to as a "second typical output current value" hereinafter) in the second current curve C23. More detailed operation of controlling the output current will be explained later by assumed output current values.

The method of controlling an output current of the power supply includes steps as follows: First, the output current is increased after the power supply is started up (S302). The power supply is started up at a startup time point t03 and then the output current Io of the power supply 10 is increased to a rated output current value Iom3 at a rated time point tm3. Note that, in order to simplify the description of controlling the output current, the transient overshot of the output current is not considered in all embodiments of the present invention.

Afterward, the output current Io is decreased when the output current Io is increased to the rated output current value Iom3 (S304). Afterward, the output current Io is further decreased after a rated maintaining time Tm3 (S306). That is, the power supply 10 continuously outputs the rated output current value Iom3 during the rated maintaining time Tm3 and then decreases the output current Io after the rated maintaining time Tm3. In this embodiment, it is assumed that the rated output current value Iom3 is equal to 450 mA, that is, the 450-mA output current Io is continuously outputted during the rated maintaining time Tm3 when the output current Io reaches to 450 mA. Finally, the output current Io is maintained at a typical output current value when the output current Io is decreased to the typical output current value (S308). That is, the typical output current value is used to provide a constant-current dimming for the LED string. In this embodiment, a first typical output current value Io13 is provided when the power supply 10 is operated under the first current curve C13. Further, it is assumed that the first typical output current value Io13 is equal to fifty percent of the rated output current value Iom3, namely, the first typical output current value Io13 is 225 mA. Similarly, a second typical output current value Io23 is provided when the power supply 10 is operated under the second current curve C23. Further, it is assumed that the second typical output current value Io23 is equal to seventy-five percent of the rated output current value Iom3, namely, the second typical output current value Io23 is 337.5 mA. Note that, the above-mentioned two typical output current values Io13, Io22 meet within the scope of the required dimming current and also the first typical output current value Io13 and the second typical output current value Io23 are less than the rated output current value Iom3. In other words, different output currents of the identical power supply can be controlled by software and firmware without the need to substitute electronic components inside the power supply, while the same power safety certification can be satisfied. That is, different output currents operated under the first current curve C13, the second current curve C23, or other current curves can be applied to the same power safety certification. Especially, the output current Io reaches to the first typical output current value Io13 or the second typical output current value Io23 at a typical time point tt3. In particular, a time difference between the rated time point tm3 and the typical time point tt3 is a current regulating time Tj3, namely, Tj3=tt3−tm3. Also, the current regulating time Tj3 is preferably controlled less than ten seconds and the rated maintaining time Tm3 is preferably controlled less than one second in present invention. Note that, the rated time point tm3, the typical time point tt3, the rated maintaining time Tm3, and the current regulating time Tj3 are controlled by a timer.

For the ordinary LED street lamp system with a dimming function, the LED street lamps are generally controlled according to ambient light. For this reason, the dimming time interval of the LED street lamps is usually controlled in time unit of hours under normal climatic conditions. Unlike the LED street lamp system, the operation of controlling the output current of the power supply 10 in the present invention is focused on the period from the starting condition to the steady-state condition of the power supply 10.

Figure 5:
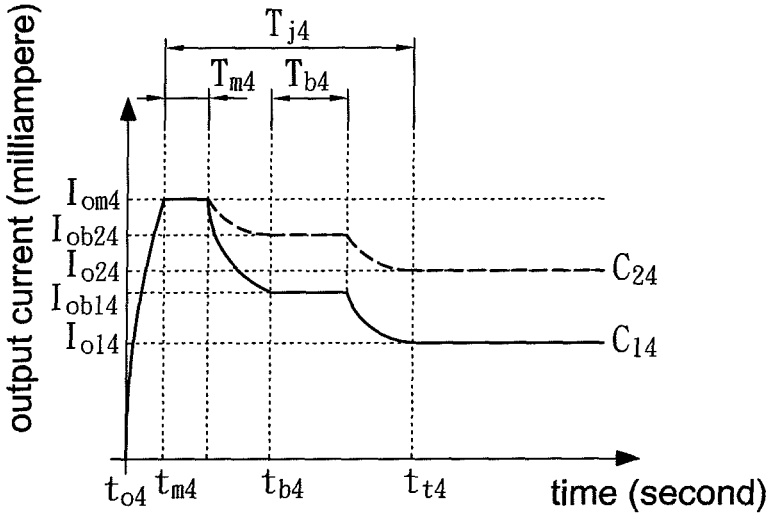
Figure 9:
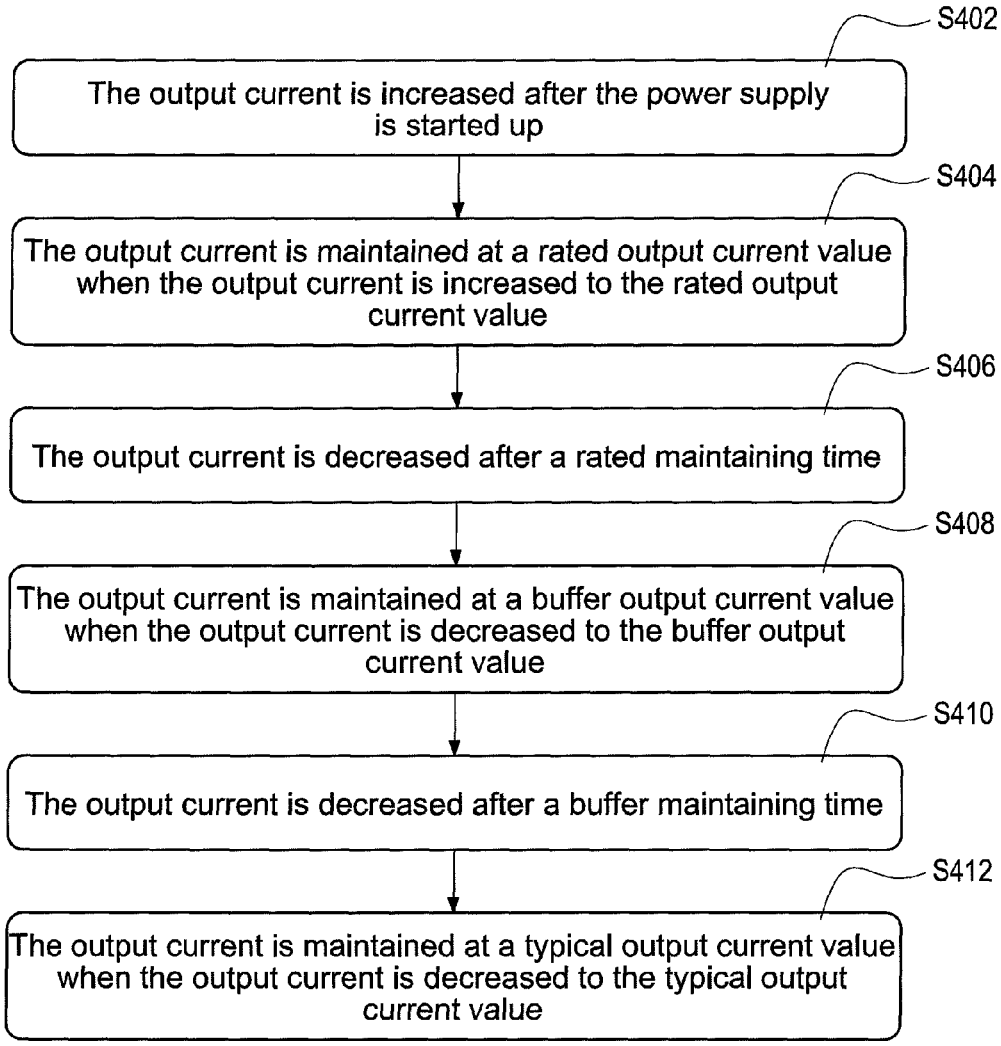

Reference is made to FIG. 5 which is a schematic waveform chart of the method of controlling output current of the power supply according to a fourth embodiment of the present invention. In following descriptions, different output current curves are exemplified for further demonstration of controlling the output current. The abscissa represents the time (in seconds) and the ordinate represents the output current (in milliamperes). Further, reference is made to FIG. 9 which is a flowchart of a method of controlling output current of the power supply according to the fourth embodiment of the present invention. Especially, there are two output current curves are shown, namely, a first current curve C14 and a second current curve C24. The major difference between the two current curves is that steady-state values of the output current are different after the power supply 10 is completely started up. In other words, the steady-state output current value (referred to as a "first typical output current value" hereinafter) in the first current curve C14 is less than that (referred to as a "second typical output current value" hereinafter) in the second current curve C24. More detailed operation of controlling the output current will be explained later by assumed output current values.

The method of controlling an output current of the power supply includes steps as follows: First, the output current is increased after the power supply is started up (S402). The power supply is started up at a startup time point t04 and then the output current Io of the power supply 10 is increased to a rated output current value Iom4 at a rated time point tm4. Note that, in order to simplify the description of controlling the output current, the transient overshoot of the output current is not considered in all embodiments of the present invention.

Afterward, the output current Io is maintained at a rated output current value when the output current to is increased to the rated output current value (S404). Afterward, the output current Io is decreased after a rated maintaining time Tm4 (S406). That is, the power supply 10 continuously outputs the rated output current value Iom4 during the rated maintaining time Tm4 and then decreases the output current Io after the rated maintaining time Tm4. In this embodiment, it is assumed that the rated output current value Iom4 is equal to 450 mA, that is, the 450-mA output current Io is continuously outputted during the rated maintaining time Tm4 when the output current Io reaches to 450 mA. Afterward, the output current Io is maintained at a buffer output current value when the output current Io is decreased to the buffer output current value (S408). Especially, the output current Io reaches to a first buffer output current value Iob14 or a second buffer output current value Iob24 at a buffer time point tb4. Afterward, the output current Io is decreased after a buffer maintaining time Tb4 (S410). That is, the power supply 10 continuously outputs the first buffer output current value Iob14 and the second buffer output current value Iob24 during the buffer maintaining time Tb4 and then decreases the output current Io after the buffer maintaining time Tb4.

Finally, the output current is maintained at a typical output current value when the output current is decreased to the typical output current value (S412). That is, the typical output current value is used to provide a constant-current dimming for the LED string. In this embodiment, a first typical output current value Io14 is provided when the power supply 10 is operated under the first current curve C14. Further, it is assumed that the first typical output current value Io14 is equal to fifty percent of the rated output current value Iom4, namely, the first typical output current value Io14 is 225 mA. Similarly, a second typical output current value Io24 is provided when the power supply 10 is operated under the second current curve C24. Further, it is assumed that the second typical output current value Io24 is equal to seventy-five percent of the rated output current value Iom4, namely, the second typical output current value Io24 is 337.5 mA. Note that, the above-mentioned two typical output current values Io14, Io24 meet within the scope of the required dimming current and also the first typical output current value Io14 and the second typical output current value Io24 are less than the rated output current value Iom4. In other words, different output currents of the identical power supply can be controlled by software and firmware without the need to substitute electronic components inside the power supply, while the same power safety certification can be satisfied. That is, different output currents operated under the first current curve C14, the second current curve C24, or other current curves can be applied to the same power safety certification. Especially, the output current Io reaches to the first typical output current value Io14 or the second typical output current value Io24 at a typical time point tt4. Further, the first buffer output current value Iob14 and the second buffer output current value Iob24 are greater than the corresponding first typical output current value Io14 and the second typical output current value Io24, respectively. Note that, a major difference between the fourth embodiment and the third embodiment (as shown in FIG. 4) is that the first buffer output current value Iob14 or the second buffer output current value Iob24 is continuously outputted during the buffer maintaining time Tb4 so that the variation of the output current Io (from the rated output current value Iom4 to the first typical output current value Io14 or the second typical output current value Io24) is more smooth. In addition, the amount of the buffer output current value between the rated output current value Iom4 and the first typical output current value Io14 or the second typical output current value Io24 can be plural according to the practical applications. In particular, a time difference between the rated time point tm4 and the typical time point tt4 is a current regulating time Tj4, namely, Tj4=tt4−tm4. Also, the current regulating time Tj4 is preferably controlled less than ten seconds, the rated maintaining time Tm4 is preferably controlled less than one second, and the buffer maintaining time Tb4 is preferably controlled less than one second in present invention. Note that, the rated time point tm4, the buffer time point tb4, the typical time point tt4, the rated maintaining time Tm4, the buffer maintaining time Tb4, and the current regulating time Tj4 are controlled by a timer.

For the ordinary LED street lamp system with a dimming function, the LED street lamps are generally controlled according to ambient light. For this reason, the dimming time interval of the LED street lamps is usually controlled in time unit of hours under normal climatic conditions. Unlike the LED street lamp system, the operation of controlling the output current of the power supply 10 in the present invention is focused on the period from the starting condition to the steady-state condition of the power supply 10.

In conclusion, the present invention has following advantages:

1. The power supply 10 outputs different output currents without changing electronic components inside the power supply but the identical power supply with different output currents can be still applied to the same power safety certification; and 2. The company competitiveness and product visibility can be improved because of the lower safety certification application fee and less safety certification application time.

Although several embodiments of the present invention have been described in detail, it will be understood that the disclosure is not limited to such details. Various substitutions will occur to those of ordinary skill in the art of the foregoing description. Therefore, all such substitutions and modifications are intended to be embraced within the scope of this disclosure.

What is claimed is:

1. A method of controlling an output current of a power supply; steps of the method comprising:

(a1) increasing the output current after the power supply is started up;

(b1) decreasing the output current when the output current is detected to increase to a rated output current value at a rated time point; and (c1) maintaining the output current at a steady-state output current value when the output current is detected to decrease to the steady-state output current value at a steady-state time point; wherein the steady-state output current value is less than the rated output current value.

2. The method of controlling the output current of the power supply in claim 1, wherein a time difference between the rated time point and the steady-state time point is a current regulating time; wherein the rated time point, the steady-state time point, and the current regulating time are controlled by a timer.

3. The method of controlling the output current of the power supply in claim 2, wherein the current regulating time is less than ten seconds.

4. A method of controlling an output current of a power supply; steps of the method comprising;

(a2) increasing the output current after the power supply is started up;

(b2) decreasing the output current when the output current is detected to increase to a rated output current value at a rated time point;

(c2) maintaining the output current at a buffer output current value when the output current is detected to decrease to the buffer output current value at a buffer time point;

(d2) further decreasing the output current after a buffer maintaining time; and (e2) maintaining the output current at a steady-state output current value when the output current is detected to decrease to the steady-state output current value at a steady-state time point; wherein the steady-state output current value is less than the buffer output current value, and the buffer output current value is less than the rated output current value.

5. The method of controlling the output current of the power supply in claim 4, wherein a time difference between the rated time point and the steady-state time point is a current regulating time; wherein the rated time point, the buffer time point, the steady-state time point, and the buffer maintaining time are controlled by a timer.

6. The method of controlling the output current of the power supply in claim 5, wherein the current regulating time is less than ten seconds and the buffer maintaining time is less than one second.

7. The method of controlling the output current of the power supply in claim 5, wherein the amount of the buffer output current value between the rated output current value and the steady-state output current value is plural; each buffer output current value is corresponding to the buffer maintaining time.

8. A method of controlling an output current of a power supply; steps of the method comprising:

(a3) increasing the output current after the power supply is started up;

(b3) maintaining the output current at a rated output current value when the output current is detected to increase to the rated output current value at a rated time point;

(c3) decreasing the output current after a rated maintaining time; and (d3) maintaining the output current at a steady-state output current value when the output current is detected to decrease to the steady-state output current value at a steady-state time point; wherein the steady-state output current value is less than the rated output current value.

9. The method of controlling the output current of the power supply in claim 8, wherein a time difference between the rated time point and the steady-state time point is a current regulating time; wherein the rated time point, the steady-state time point, the rated maintaining time, and the current regulating time are controlled by a timer.

10. The method of controlling the output current of the power supply in claim 9, wherein the current regulating time is less than ten seconds and the rated maintaining time is less than one second.

11. A method of controlling an output current of a power supply; steps of the method comprising:

(a4) increasing the output current after the power supply is started up;

(b4) maintaining the output current at a rated output current value when the output current is detected to increase to the rated output current value at a rated time point;

(c4) decreasing the output current after a rated maintaining time;

(d4) maintaining the output current at a buffer output current value when the output current is detected to decrease to the buffer output current value at a buffer time point;

(e4) further decreasing the output current after a buffer maintaining time; and (f4) maintaining the output current at a steady-state output current value when the output current is detected to decrease to the steady-state output current value at a steady-state time point; wherein the steady-state output current value is less than the buffer output current value, and the buffer output current value is less than the rated output current value.

12. The method of controlling the output current of the power supply in claim 11, wherein a time difference between the rated time point and the steady-state time point is a current regulating time; wherein the rated time point, the buffer time point, the typical time point, the rated maintaining time, the buffer maintaining time, and the current regulating time are controlled by a timer.

13. The method of controlling the output current of the power supply in claim 12, wherein the current regulating time is less than ten seconds, the rated maintaining time is less than one second, and the buffer maintaining time is less than one second.

14. The method of controlling the output current of the power supply in claim 12, wherein the amount of the buffer output current value between the rated output current value and the steady-state output current value is plural; each buffer output current value is corresponding to the buffer maintaining time.

15. A power supply system for dimming a light-emitting diode string; the power supply system comprising:

a power supply receiving an AC power and converting the AC power into a DC power for driving the light-emitting diode string;

a current-detecting unit detecting an output current of the power supply and producing a current feedback signal;

an output current control unit receiving a dimming signal and producing a current control signal, and further setting at least one steady-state output current value; and a feedback circuit receiving the current feedback signal and the current control signal and producing a feedback control signal to control the output current of the power supply by the output current control unit;

wherein the output current is increased after the power supply is started up; and then the output current is decreased when the output current is detected to increase to a rated output current value at a rated time point; and finally the output current is maintained at the steady-state output current value when the output current is detected to decrease to the steady-state output current value at a steady-state time point; wherein the steady-state output current value is less than the rated output current value.

16. The power supply system in claim 15, wherein the dimming signal is a PWM (pulse-width modulation) signal and the light-emitting diode string is dimmed by controlling a duty cycle of the dimming signal.

* * * * *